US006233922B1

(12) United States Patent
Maloney

(10) Patent No.: US 6,233,922 B1
(45) Date of Patent: May 22, 2001

(54) ENGINE FUEL CONTROL WITH MIXED TIME AND EVENT BASED A/F RATIO ERROR ESTIMATOR AND CONTROLLER

(75) Inventor: Peter James Maloney, New Hudson, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/447,613

(22) Filed: Nov. 23, 1999

(51) Int. Cl.[7] ..... F02D 41/14

(52) U.S. Cl. ..... 60/276; 60/285; 123/674; 123/696; 701/109

(58) Field of Search ..... 123/672, 674, 123/693, 694, 696; 60/274, 276, 277, 285; 701/109

(56) References Cited

U.S. PATENT DOCUMENTS 5,390,489 * 2/1995 Kawai et al. ..... 60/276
5,524,598 * 6/1996 Hasegawa et al. ..... 123/672

OTHER PUBLICATIONS

SAE Technical Paper 940972, "Model–Based Air–Fuel Ratio Control in SI Engines with a Switch–Type EGO Sensor", Alois Amstutz, et al.

SAE Technical Paper 950846, "Model–Based Air–Fuel Ratio Control of A Lean Multi–Cylinder Engine", N. P. Fekete, et al.

* cited by examiner

*Primary Examiner*—Tony M. Argenbright
(74) *Attorney, Agent, or Firm*—Vincent A. Cichosz

(57) ABSTRACT

An improved closed-loop feedback fuel control with a model-based A/F ratio estimator, wherein the estimator, controller and portions of the model are updated on a fixed time interval basis, thereby minimizing the impact of the control on event-based throughput. Engine transport delays and oxygen sensor dynamics are modeled to estimate the sensed A/F ratio, and the estimate is compared with the sensed A/F ratio to adaptively adjust the model and to develop a closed-loop adjustment of the commanded fuel amount. The engine transport delay model is carried out on an engine event basis, but the sensor dynamics model is carried out on a time basis to accurately reflect the analog nature of the sensor. The estimator and the controller are also carried out on a time basis to reduce throughput requirements at higher engine speeds, and the control gain is scheduled to account for differences between the engine event and time update rates. The control enables numerous control enhancements, including flexibility to topology variations (such as sensor placement, sensor type and sensor characteristics), ease of calibration, and the ability to easily calibrate and schedule A/F ratio perturbations for catalytic conversion efficiency optimization.

10 Claims, 5 Drawing Sheets

ENGINE FUEL CONTROL WITH MIXED TIME AND EVENT BASED A/F RATIO ERROR ESTIMATOR AND CONTROLLER

TECHNICAL FIELD

This invention relates to closed-loop fuel control for an internal combustion engine, and more particularly to a control based on a system model and air/fuel (A/F) ratio error estimator.

BACKGROUND OF THE INVENTION

The need for precise control of A/F ratio in motor vehicles has let to the development of controllers in which all or a portion of the engine air flow and exhaust system dynamics are mathematically modeled to estimate the sensed A/F ratio, and to adaptively adjust both the model and the base fuel control based on deviations of the estimated A/F ratio from the sensed A/F ratio. See, for example, SAE Paper N. 950846, by Fekete, Guden and Powell, entitled Model-Based Air-Fuel Ratio Control of a Lean Multi-Cylinder Engine. However, such controls tend to be complex, and when updated in time with the engine firing events, present excessive computational throughput requirements at higher engine speeds. Accordingly, such control strategies tend to be cost-prohibitive for most applications.

SUMMARY OF THE INVENTION

The present invention is directed to an improved closed-loop feedback fuel control with a model-based A/F ratio estimator, wherein the estimator, controller and portions of the model are updated on a fixed time interval basis, thereby minimizing the impact of the control on event-based throughput. Engine transport delays and oxygen sensor dynamics are modeled to estimate the sensed A/F ratio, and the estimate is compared with the sensed A/F ratio to adaptively adjust the model and to develop a closed-loop adjustment of the commanded fuel amount. The engine transport delay model is carried out on an engine event basis, but the sensor dynamics model is carried out on a time basis to accurately reflect the analog nature of the sensor. The estimator and the controller are also carried out on a time basis to reduce throughput requirements. at higher engine speeds, and the control gain is scheduled to account for differences between the exhaust gas measurements, which occur at the engine event frequency, and the controller time update frequency.

The subject control strategy enables numerous control enhancements, including flexibility to topology variations (such as sensor placement, sensor type and sensor characteristics), ease of calibration, and the ability to easily calibrate and schedule A/F ratio perturbations for catalytic conversion efficiency optimization.

DESCRIPTION OF THE PREFERRED EMBODIMENT

Figure 1:
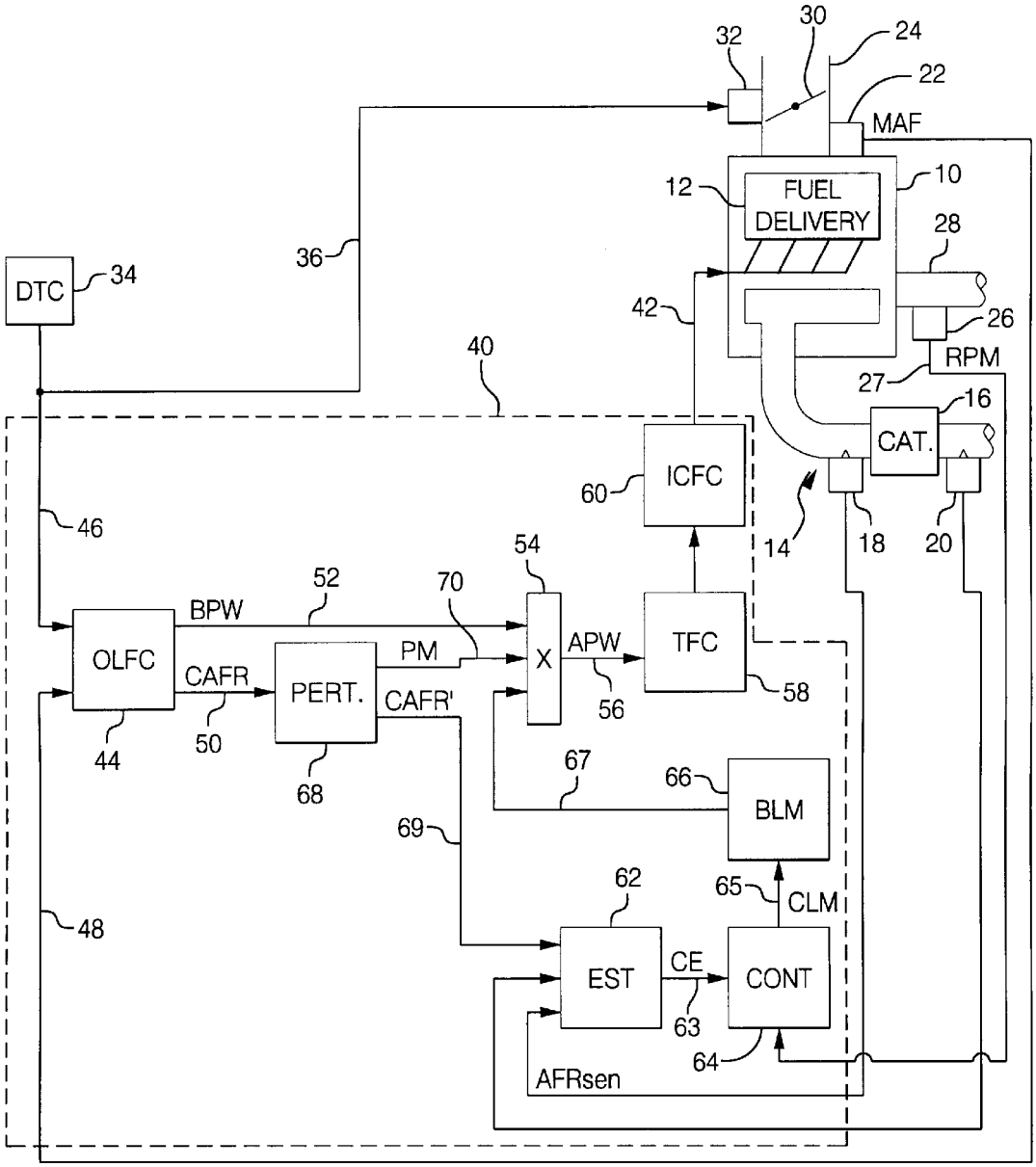
FIG. 1 is a diagram showing an engine fuel control strategy according to this invention, including an A/F ratio perturbation controller, a model-based A/F ratio estimator, and a closed-loop fuel controller.

Referring to FIG. 1, the fuel control of this invention is principally described in the context of an automotive internal combustion engine 10 having an electronically controlled fuel delivery system 12, and an exhaust system 14 including a three-way catalytic converter 16, an upstream universal exhaust gas oxygen (UEGO) sensor 18 (also known as an analog or wide-range air/fuel sensor), and a downstream switching oxygen sensor 20. In certain other embodiments, discussed below, the locations of the UEGO and switching sensors 18, 20 may be swapped, or switching sensors may be used both upstream and downstream of catalytic converter 16. Other sensors depicted in FIG. 1 include a mass air flow (MAF) sensor 22 coupled to the engine intake manifold 24, and an engine speed (RPM) sensor 26 coupled to the engine output shaft 28. Also in the illustrated embodiment, the engine 10 has a throttle 30 positioned within the manifold 24 by a motor-driven (or alternatively, cable-driven) throttle actuator 32, under the control of a driver torque command (DTC) circuit 34 via line 36. The DTC circuit 34 may be responsive to various un-depicted elements such as a driver-manipulated accelerator pedal, a cruise control circuit, a traction control circuit, and so on.

The remaining elements (also referred to herein as circuits) depicted in FIG. 1 relate to the fuel control of engine 10, a represent functional blocks of hardware and/or software residing within a microprocessor-based engine control module 40. In the illustrated embodiment, the engine control module 40 is responsible for suitably activating the engine fuel delivery system 12 via control lines 42. The fuel control acts primarily in response to the DTC signal, which is applied as one of several inputs to an Open-Loop Fuel Control (OLFC) circuit 44 via line 46. The OLFC circuit also receives the MAF signal via line 48, and operates in an open-loop and generally conventional manner to produce a commanded A/F ratio (CAFR) signal on line 50, and a corresponding fuel injection base pulse width (BPW) signal on line 52. Alternate control strategies based on engine speed and intake manifold pressure (instead of MAF) are also conventional and well known. Various methods of scheduling the commanded A/F ratio CAFR are also well known in the art, and not described here. The BPW signal on line 52 is modified by a vector of multipliers 54 to produce an adjusted pulse width (PAPW) signal on line 56, as described below. In turn, the APW signal is corrected for transient fueling conditions by the Transient Fuel Controller (TFC) 58 (which alternatively, may be implemented within the OLFC 44), and further adjusted for cylinder-to-cylinder variations of engine 10 by the Individual Cylinder Fuel Controller (ICFC) 60, which generates the individual fuel control signals on lines 42. The controllers 58 and 60 may implement any of a number of known and conventional control strategies, and are not particularly relevant or critical to the control of the present invention.

The control of this invention is concerned primarily with the development of a suitable closed-loop feedback term which is applied to the multiplier 54 for the purpose of adjusting the delivered fuel quantity so that the A/F ratio at the catalytic converter 16 will actually correspond to the commanded A/F ratio CAFR, or in the preferred embodiment, to a perturbated version (CAFR') of CAFR. The control involves utilizing a model-based estimator 62 to estimate the A/F ratio that should be sensed by the UEGO sensor 18, and to develop a leading control error (CE) signal on line 63 based on the deviation between the estimated and sensed A/F ratios; and a controller 64 for developing a closed-loop multiplier (CLM) on line 65 based on the control error CE signal on line 63 and the engine speed signal RPM on line 27. The estimator 62 and controller 64 are described in detail below in reference to FIGS. 3 and 4, respectively. In the illustrated embodiment, the closed-loop multiplier CLM is applied as an input to a block learn module (BLM) 66, which includes a number of fuel correction tables that are adaptively adjusted based on the CLM, resulting in the generation of a closed-loop feedback signal on line 67 for application to multiplier 54.

Perturbation of the CAFR is customarily practiced in automotive engine controls as a means of enhancing the conversion efficiency of a catalytic converter. The perturbation frequency and amplitude characteristics are typically determined experimentally and indirectly via control gains for a given powertrain configuration, but the techniques employed to identify the optimal characteristics vary widely, and typically entail considerable calibration effort. Accordingly, a significant aspect of this invention resides in the implementation of perturbation circuits 68 in the overall control strategy described above. As fully described below in reference to FIG. 2, the perturbation circuit (PERT) 68 enables direct control of the perturbation frequency, amplitude, and bias offset. The PERT circuit 68 generates a perturbated commanded A/F ratio (CAFC') signal on line 69 for application to the estimator 62, and a corresponding perturbation multiplier (PM) on line 70 for application to the multiplier 54. As a result, the estimator 62 and controller 64 cooperate to produce a closed-loop multiplier (CLM) that causes the scheduled A/F perturbations to occur at the sensing location of UEGO 18. An additional, but related, function of perturbation circuit 68 concerns an on-board development tool for sweeping various combinations of perturbation frequency and amplitude in order to streamline the calibration process.

Figure 2:
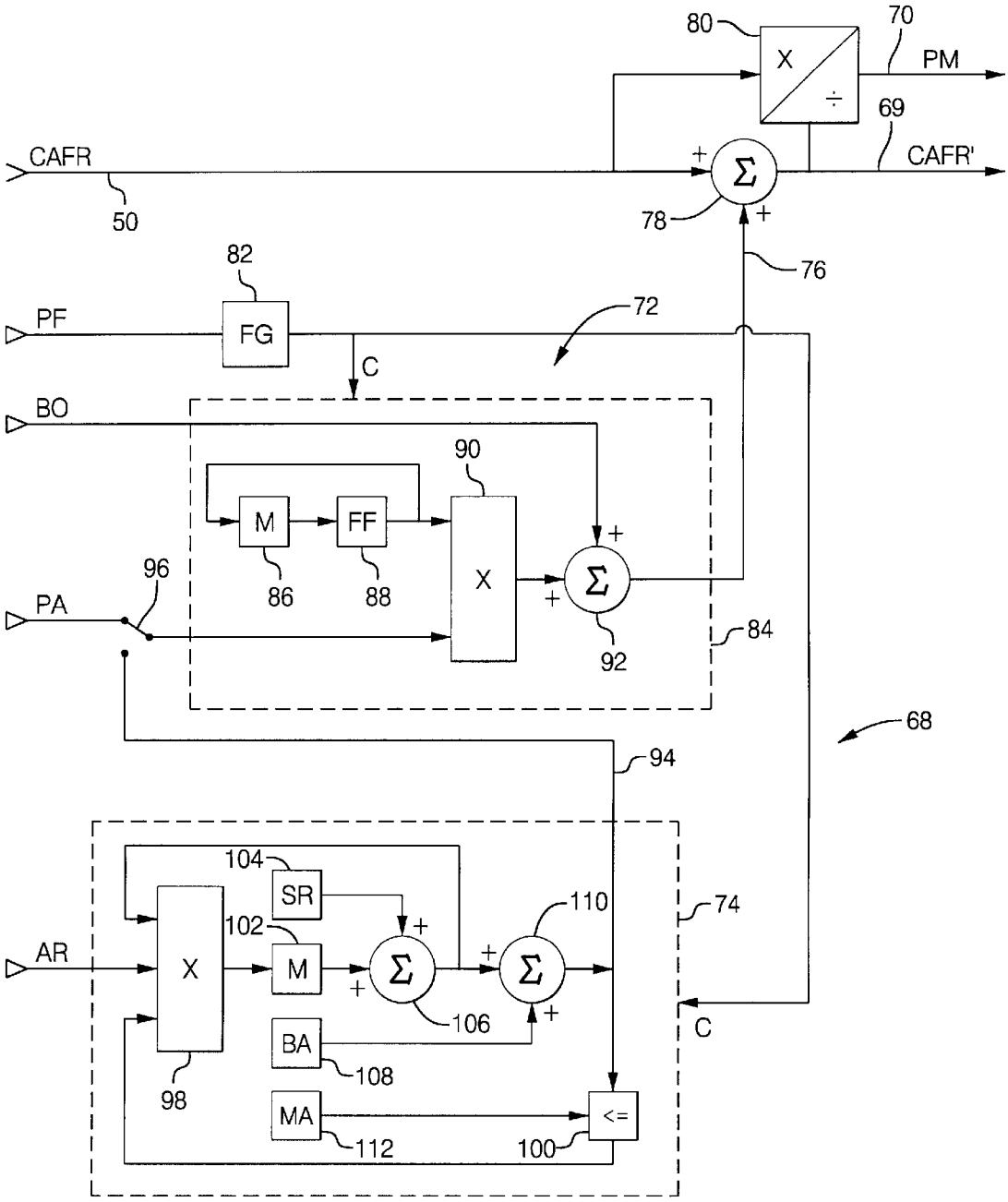
FIG. 2 is a diagram detailing the A/F ratio perturbation controller of FIG. 1.

Referring specifically to FIG. 2, the perturbation circuit 68 includes a square-wave generator 72 and an amplitude sweep tool 74. The output of the square-wave generator on line 76 is added to the commanded A/F ratio CAFR in summer 78 to form the perturbated version CAFR' on line 69. The perturbation multiplier PM on line 70 is obtained by dividing CAFR by CAFR' in the arithmetic block 80. The various inputs designated PF, BO and PA are calibration constants utilized by the square-wave generator 72, and correspond to the desired perturbation frequency (PF), perturbation amplitude (PA) and bias offset (BO). The perturbation frequency PF is applied to a frequency generator 82, which generates a corresponding clock signal (C) to trigger a state change of the components within the boses 74 and 84. The coupled memory 86 and flip-flop 88 provide a first input of alternating polarity to the multiplier 90, and the perturbation amplitude PA forms a second input. The alternating polarity output of multiplier 90 is added to the bias offset BO by summer 92 to form the square-wave generator output on line 76. With this simple arrangement, the calibration engineer can independently adjust the PF, BO and PA to achieve the best catalytic conversion efficiency, thereby significantly reducing the calibration effort, compared to prior control arrangements. In practice, PF, BO and PA are scheduled by table look up as a function of engine operating conditions, such as exhaust gas flow rate and temperature.

The amplitude sweep tool 74 is calibration tool that provides a perturbation amplitude signal on line 94 for selectively overriding the calibrated perturbation amplitude PA. The switch 96 is used to select the desired perturbation amplitude input for square-wave generator 72; in the indicated position, the calibrated PA value is selected, while in the opposite position, the amplitude signal on line 94 is selected. The amplitude sweep tool 74 is designed to sweep the amplitude signal on line 94 between base and maximum amplitude values BA, MA, upon activation of the amplitude reset (AR) input. The calibration engineer can use the amplitude sweep tool 74 to quickly determine the optimum combination of PF and PA by sweeping the amplitude signal for each of a number of PF settings, while monitoring the conversion efficiencies for specified exhaust gas constituents. When the optimum settings are determined, the optimum PA and PF settings are stored, and the switch 96 is positioned as shown in FIG. 2.

Within the amplitude sweep tool 74, a multiplier 98 is reset to zero by either of the AR input and the compare circuit 100. The multiplier output is supplied to a memory 102, and the output of memory 102 is supplied along with the step rate (SR) 104 to the summer 106. The output of summer 106 is supplied as an input to multiplier 98, and is added to the base amplitude (BA) by summer 110 to form the perturbation amplitude signal on line 94. When the perturbation amplitude signal on line 94 reaches the maximum amplitude (MA) 112, the compare circuit 100 resets multiplier 98, to begin a new amplitude sweep.

Figure 3:
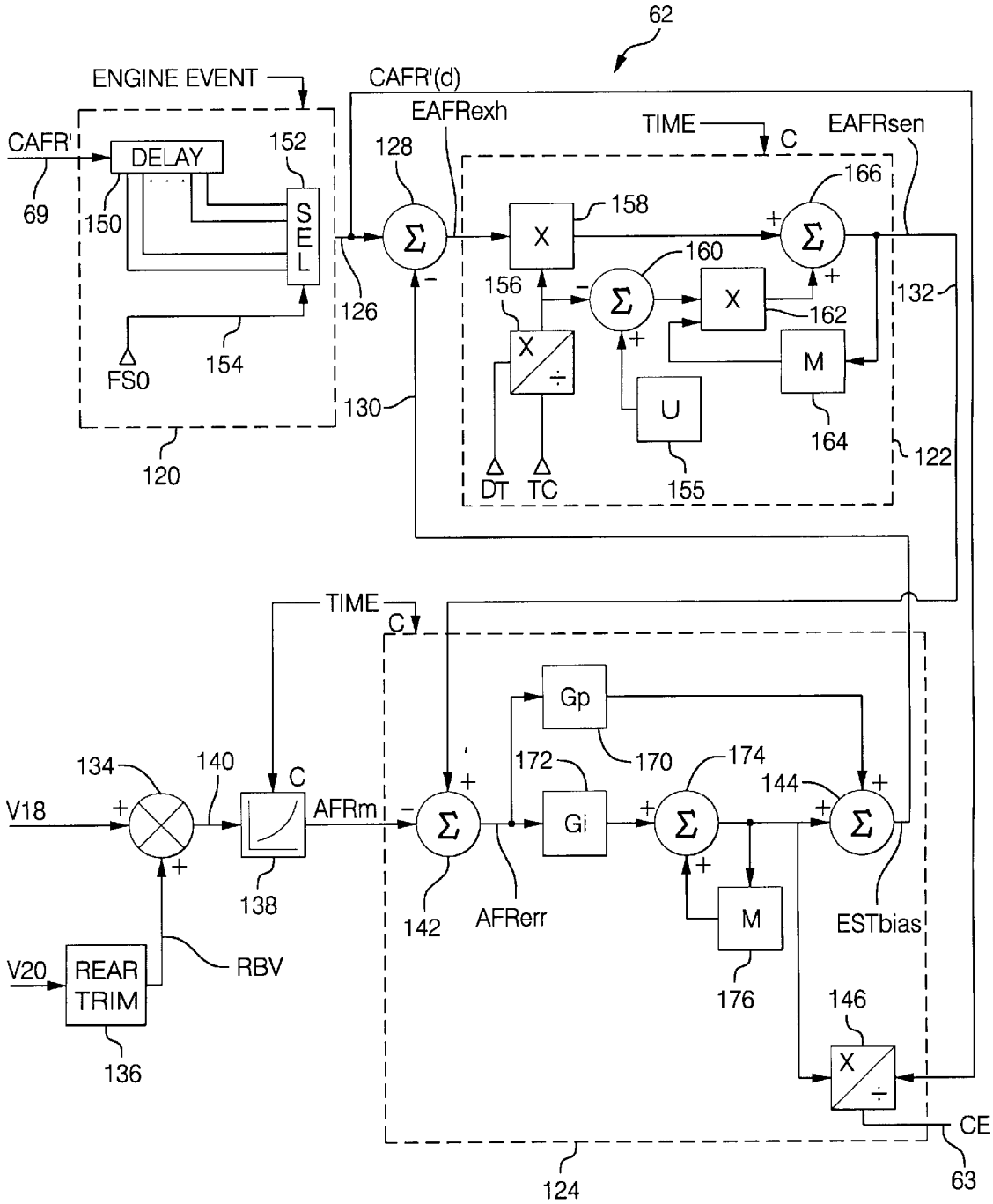
FIG. 3 is a diagram detailing the A/F ratio estimator of FIG. 1.

Referring now to FIG. 3, the estimator 62 comprises an engine delay mode 120, a UEGO sensor dynamics model 122 and a bias estimator 124. The engine delay model imparts a variable engine event-based delay to the perturbated command A/F ratio CAFR' on line 50, producing a delayed version CAFR'(d) on line 126 corresponding to the expected A/F ratio upstream of catalytic converter 16 at the location of the upstream sensor 18. The signal CAFR'(d) is adjusted by summer 128 in accordance with a bias estimator feedback signal on line 130, forming a corrected estimate of the A/F ratio in the exhaust upstream of the catalytic converter 16, designated as EAFRexh. The output of summer 128 is then applied as an input to sensor model 122, which models the sensor dynamics and produces a signal EAFRsen on line 132 corresponding to the estimated A/F ratio at the location of UEGO sensor 18. The actual output voltage of sensor 18 (designated as V18) is sampled on an engine firing event basis, and is combined in summer 134 with a rear trim bias voltage (RBV) developed by the rear trim circuit 136 in response to the output voltage of downstream switching sensor 20 (designated as V20). The rear trim circuit 136 may be conventional in nature, and serves to calibrate the UEGO sensor 18 relative to the voltage target of rear switching sensor 20. The table 138 converts the trimmed oxygen sensor voltage on line 140 to a measured A/F ratio, designated as AFRm. In bias estimator 124, the summer 142 determines and A/F ratio error (AFRerr) according to the difference between AFRm and EAFRsen. Integral and proportional feedback terms based on AFRerr are combined in summer 144 to form the above-mentioned bias estimator feedback signal on line 130. And finally, the integral feedback term is divided by CAFR'(d) in arithmetic circuit 146 to form the control error CE signal on line 63.

The engine delay model is engine event based, and constructs a variable delayed version of CAFR' by storing successive samples of CAFR' in successive registers of delay unit 150, and selecting an appropriate sample for application to line 126 via selector 152. The selector 152, in turn, is controlled by a calibrated front sensor delay FSD value (0, 1 . . . N) on line 154. The FSD values are selected by the calibration engineer based on measured on estimated independent parameters of engine 10, and in practice, are scheduled by table look up as a function of engine operating conditions representative of exhaust mass flow rate. This calibration can be facilitate by setting the perturbation frequency PF of perturbation circuit 68 to a very low frequency, and counting the number of engine events required for the perturbations to reach the UEGO or switching sensors 18, 20.

The sensor model 122 mimics the dynamics of UEGO sensor 18 by filtering EAFRexh with a time-based first-order filter defined by the calibration values ΔT and TC. The term ΔT is the filter update time increment (corresponding to clock frequency C), and TC is the filter time constant. The block 155 (U) represents a unity offset. The arithmetic unit 156 divides the update time increment ΔT by TC, and supplies the result to multiplier 158 and summer 160. The summer forms a difference between ΔT/TC and the offset U, and supplies the result to multiplier 162, which also receives a previous value of the model output from memory 164. The model input EAFRexh is multiplied by ΔT/TC with multiplier 158, and the result is summed with the output of multiplier 162 in summer 166 to form the output signal EAFRsen on line 132.

As mentioned above, the estimator bias feedback signal on line 130 is formed in bias estimator 124 by combining proportional and integral feedback terms in summer 144. The proportional term is simply obtained by applying the proportional gain (Gp) 170 to the error AFRerr. The integral term is obtained by applying the integral (Gi) gain 172 to the error AFRerr, and summing the result in summer 174 with a previous value of the integral term, supplied by memory (M) 176. The arithmetic unit 146 normalizes the integral term relative to CAFR(d) to form the control error signal CE. As a result, the control error signal CE represents a percentage A/F ratio error, allowing the controller 64 to use the same gains for A/F ratio operating range.

Figure 4A:
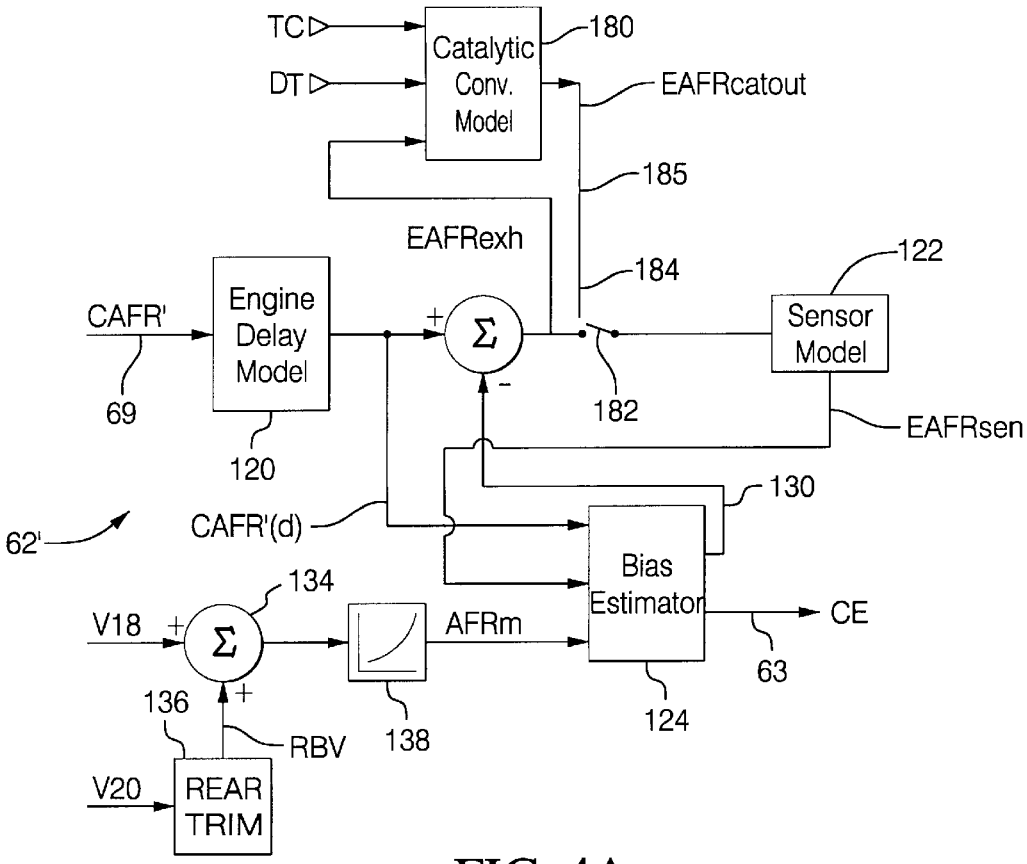
FIGS. 4A and 4B are diagrams detailing an alternate embodiment of the A/F ratio estimator of FIG. 3.
Figure 4B:
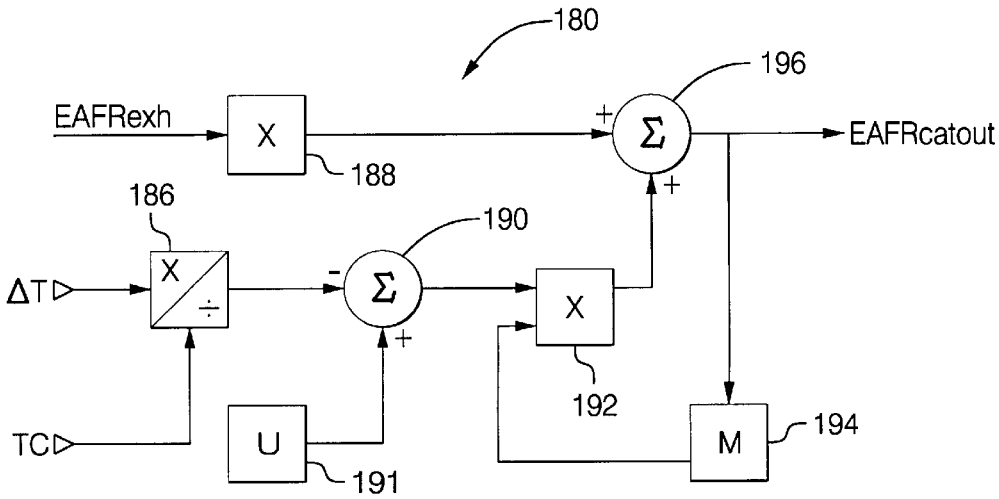

FIGS. 4A and 4B, taken together, depict an alternate embodiment of estimator 62, designated as 62', which is adaptable to mechanizations in which the UEGO sensor 18 is located either upstream or downstream of the catalytic converter 16. In certain instances, locating the sensor 18 downstream of the converter 16 facilitates combining the senor 18 with a NOX sensor, for example. FIG. 4A mirrors FIG. 3, except for the simplification of elements 120, 122, 124 and the addition of a catalytic converter model 180 and a switch 182. In common respects, the reference numerals used in FIG. 3 have been repeated. FIG. 4B depicts the catalytic converter model 180 in detail. With the switch 182 in the position indicated in FIG. 4A, the bias estimator 62' is equivalent to the bias estimator 62 depicted in FIG. 3. However, when the switch 182 is positioned to contact the terminal 184, the catalytic converter model 180 is interposed between summer 128 and the sensor model 122. In such event, the input into sensor model 122 on line 185, represents the estimated A/F ratio at the outlet of catalytic converter 16, on EAFRcatout.

Referring to FIG. 4B, the catalytic converter model 180 mimics the dynamics of catalytic converter 16 by filtering EAFRexh with a time-based first-order filter defined by the calibration values ΔT and TC. The term ΔT is the filter update time increment, TC is the filter time constant (which of course is different than the time constant used in sensor model 122). The arithmetic unit 186 divides the update time increment ΔT by TC, and supplied the result to multiplier 188 and summer 190. The summer forms a difference between ΔT/TC and the unity offset (U) 191, and supplies the result to multiplier 192, which also receives a previous value of the model output from memory 194. The model input EAFRexh is multiplied by ΔT/TC with multiplier 188, and the result is summed with the output of multiplier 192 in summer 196 to form the output signal EAFRcatout on line 185.

Figure 5:
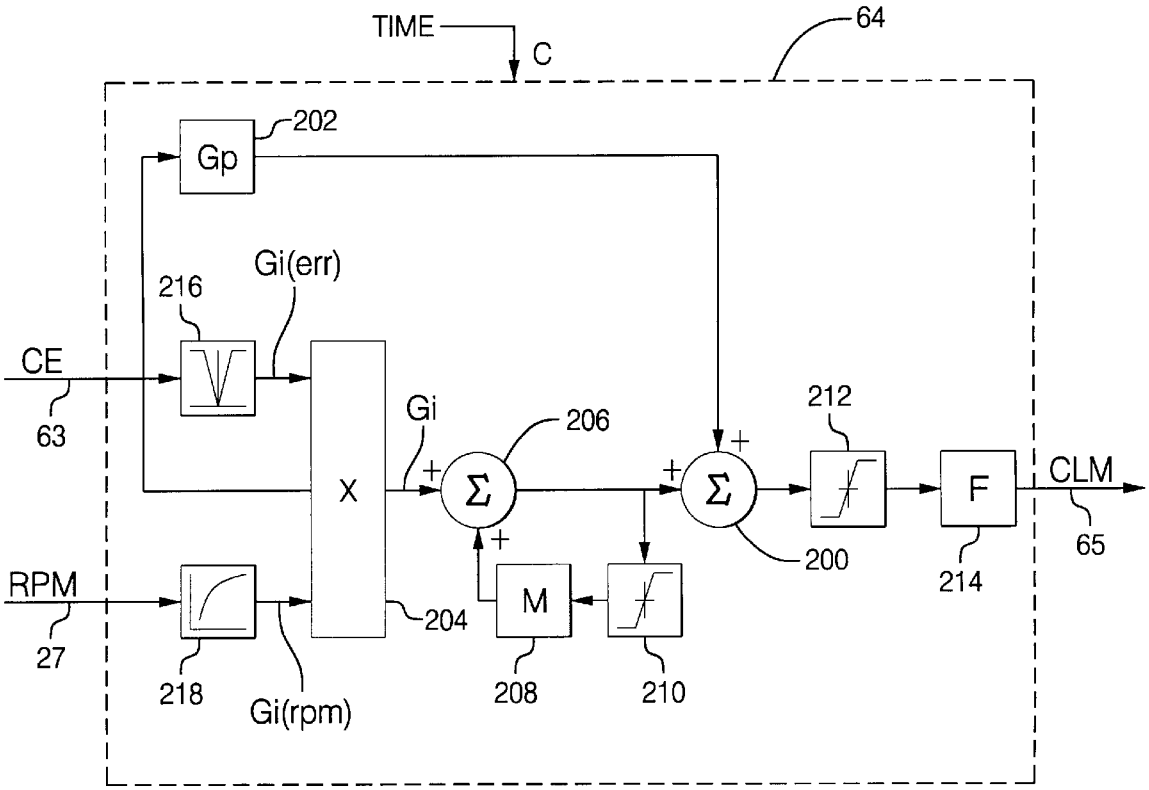
FIG. 5 is a diagram detailing the closed-loop fuel controller of FIG. 1.

Referring to FIG. 5, the controller 64 develops a time-based closed-loop feedback multiplier CLM on line 65 for modifying the base fuel pulse width BPW, forcing the A/F ratio at the senor 18 to conform with the CAFR'. The feedback multiplier comprises proportional and integral terms, which are applied to the summer 200. The proportional term is obtained simply by applying the proportional gain Gp 202 to the control error CE signal on line 63. The integral gain term is formed by applying an integral gain to the control error CE in multiplier 204, and summing the result in summer 206 with a previous value of the integral term, supplied by memory 208. The previous integral term value supplied by memory 208 is limited to predefined minimum and maximum values, as indicated by limiter 210. The output of summer 200 (and hence, the output of controller 64) is also limited to predefined minimum and maximum values by the limiter 212, and the output of limiter 212 is applied to an arithmetic unit 214, which converts the limited feedback signal into the closed-loop multiplier CLM.

The integral gain comprises first and second components determined respectively as a function of the control error CE and the engine speed RPM. The first component, Gi(err), generated by table 216, is high for large values of control error CE, but rapidly decreases when the magnitude of the control error CE falls below a threshold, as indicated by the table graph. Thus, the feedback is high for aggressive closed-loop fuel correction when fast dynamic response is needed, and low for stability enhancement when the A/F ratio is at or near the commanded value. The second component, Gi(rpm), generated by table 218, progressively increases with engine speed RPM so that the closed-loop multiplier CLM generated by the time-based controller 64 matches the dynamics of the fuel delivery system 14 (and the corresponding rate of new information at UEGO 18), which is inherently engine event-based. Thus, the integral gain component Gi(rpm) is low at low engine speeds when the time increment rate of the controller 64 exceeds the event rate of engine 10, and high at high engine speeds when the event rate of engine 10 exceeds the time increment rate of the controller 64.

Calibration of the controller gains for disturbance rejection can be facilitated by replacing the perturbated input CAFR' to estimator 62 on line 69 with the un-perturbated signal CAFR on line 50, while retaining the perturbation multiplier input PM to multiplier 54 on line 70. This produces a known and controllable (via perturbation circuit 68) A/F ratio disturbance for judging the suitability of the controller gains.

In summary, the control of this invention provides a practical and cost-efficient implementation of a model-based A/F ratio estimator by carrying out the slow and calculation-intensive portions of the control on a time basis, adjusting the response of the control to match the event-based engine fuel delivery system. In addition to accurate A/F ratio control, the control topology allows an easily calibrated method of perturbation the controlled A/F ratio, and permits the flexibility to adapt the control to different powertrain mechanizations. Calibration of the perturbation schedule is also facilitated by the on-board catalyst sweep tool, which eliminates the need for special external equipment during development. Further, direct control of the perturbation characteristics facilitates calibration of the engine delay model and the controller gains. While the present invention has been described in reference to the illustrated embodiments, it is expected that various modification in addition to those mentioned above will occur to those skilled in the art. For example, the various sensor models may be enhanced to represent more complex dynamic behavior, the calibration sweep tool could be designed to sweep frequency instead of amplitude, and so on. Thus, it will be understood that methods incorporating these and other modifications may fall within the scope of this invention, which is defined by the appended claims.

What is claimed is:

1. A fuel control for an internal combustion engine including an open-loop air/fuel ratio command, a fuel pulse width command corresponding to said air/fuel ratio command, an oxygen sensor for measuring an exhaust gas air/fuel ratio, a periodically updated estimator for estimating an output of the oxygen sensor based on the commanded air/fuel ratio and characteristic parameters of the engine and oxygen sensor and generating a leading control error signal based on a difference between the estimated and actual outputs of the oxygen sensor, and a periodically updated controller responsive to the control error signal for developing a feedback signal for adjusting the commanded fuel pulse width so as to produce the commanded air/fuel ratio, the improvement wherein:

the estimator includes an engine delay model periodically updated at a variable rate in synchronism with engine cooperation and responsive to the commanded air/fuel ratio for estimating an air/fuel ratio at the oxygen sensor, and a sensor model periodically updated at a fixed rate and responsive to the estimate of the engine delay model for estimating the output of the oxygen sensor; and the feedback signal developed by the controller is adjusted to account for differences between said variable update rate and said fixed update rate.

2. The fuel control of claim 1, wherein:

the engine delay model is updated in synchronism with a firing frequency of the engine; and the feedback signal developed by the controller includes a integral gain term that is increased with increasing engine firing frequency.

3. The fuel control of claim 2, wherein the integral gain term is reduced when a magnitude of the leading control error is less than a threshold value.

4. The fuel control of claim 1, wherein the estimator updates the leading control error signal at said fixed update rate.

5. The fuel control of claim 1, wherein said controller develops said feedback signal at said fixed update rate.

6. The fuel control of claim 1, wherein the estimator normalizes the difference between the estimated and actual outputs of the oxygen sensor relative to the estimate of the engine delay model to form said leading control error.

7. The fuel control of claim 1, including:

a perturbator including frequency and amplitude inputs for perturbating the commanded air/fuel ratio and fuel pulse width at the inputted frequency and amplitude; and a calibration tool for selectively overriding one of the frequency and amplitude inputs, and sweeping the overridden input over a predefined range of values.

8. The fuel control of claim 7, wherein the commanded fuel pulse width is perturbated by a ratio of the commanded air/fuel ratio to the perturbated commanded air/fuel ratio.

9. The fuel control of claim 1, wherein the controller includes calibrated control gains, the fueled control including:

a perturbator including frequency and amplitude inputs for perturbating the fuel pulse width at the inputted frequency and amplitude, thereby producing a controlled air/fuel ratio disturbance for purpose of calibrating said control gains.

10. The fuel control of claim 1, where the control includes an exhaust gas catalytic converter, and the oxygen sensor is located downstream of the catalytic converter, the improvement wherein:

the estimator includes an engine delay model periodically updated at a variable rate in synchronism with engine operation and responsive to the commanded air/fuel ratio for estimating an air/fuel ratio in the exhaust gas, a catalytic converter model periodically updated at a fixed rate and responsive to the estimate of the engine delay model for estimating and air/fuel ratio at the oxygen sensor, and a sensor model periodically update at a fixed rate and responsive to the estimate of the catalytic converter model for estimating the outputs of the oxygen sensor.

* * * * *